US006289177B1

(12) United States Patent
Finger et al.

(10) Patent No.: US 6,289,177 B1
(45) **Date of Patent: *Sep. 11, 2001**

(54) ENCAPSULATED HEATING ELEMENT FLUID HEATER

(76) Inventors: John W. Finger, 1170 Sunset Dr. West, Beresford, SD (US) 57004; Arden L. Larson, 4300 S. Birchwood Ave., Sioux Falls, SD (US) 57103

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/108,123

(22) Filed: Jun. 29, 1998

(51) Int. Cl.[7] ..... H05B 3/78; F24H 1/10
(52) U.S. Cl. ..... 392/485; 392/447; 392/455
(58) Field of Search ..... 392/485, 447, 392/455; 219/436, 617

(56) References Cited

U.S. PATENT DOCUMENTS

| | | | |
|---|---|---|---|
| 2,589,566 | 3/1952 | Neth et al. . | |
| 2,640,138 | 5/1953 | Merritt . | |
| 2,813,964 | 11/1957 | Cerulli . | |
| 2,866,884 | 12/1958 | Minier . | |
| 3,134,889 | 5/1964 | Drugmand . | |
| 3,286,079 | 11/1966 | Hynes et al. . | |
| 3,446,937 | 5/1969 | Hugentobler . | |
| 3,610,330 | 10/1971 | Gamal El Din Nasser . | |
| 3,638,619 | 2/1972 | Hall et al. . | |
| 3,721,291 | 3/1973 | Massaro, Jr. et al. . | |
| 3,768,132 | 10/1973 | Garber . | |
| 3,831,673 | 8/1974 | Hayden et al. . | |
| 3,860,787 | 1/1975 | Strobach . | |
| 3,992,608 | 11/1976 | Snavely . | |
| 4,185,187 | 1/1980 | Rogers . | |
| 4,286,139 | 8/1981 | Taylor . | |
| 4,345,549 | 8/1982 | Colmano . | |
| 4,364,161 | 12/1982 | Stading . | |
| 4,395,618 * | 7/1983 | Cunningham | 392/492 |
| 4,436,983 | 3/1984 | Solobay . | |
| 4,465,039 | 8/1984 | Snelgrove et al. . | |
| 4,514,617 | 4/1985 | Amit . | |
| 4,552,162 | 11/1985 | Finger . | |
| 4,567,350 | 1/1986 | Todd, Jr. . | |
| 5,058,197 | 10/1991 | Honkomp et al. . | |
| 5,159,659 | 10/1992 | Cameron . | |
| 5,292,056 | 3/1994 | Borchert et al. . | |
| 5,305,419 | 4/1994 | Cameron . | |
| 5,408,578 | 4/1995 | Bolivar . | |

* cited by examiner

*Primary Examiner*—Teresa Walberg
*Assistant Examiner*—Thor Campbell

(57) ABSTRACT

A new encapsulated heating element fluid heater for heating a fluid such as water. The inventive device includes a vessel and an end cap. The end cap has a plurality of bores therethrough extending between the first and second ends of the end cap. A plurality of elongate heating element rods extend through the bores of the end cap and each heating element rod has a heating portion outwardly extending from the first end of the end cap and an electric coupling portion outwardly extending from the second end of the end cap. The first end of the end cap is inserted into an open end of the vessel such that the heating portions of the heating elements extend into the vessel. The end cap is then welded to the end of the vessel.

7 Claims, 7 Drawing Sheets

ENCAPSULATED HEATING ELEMENT FLUID HEATER

BACKGROUND OF THE INVENTION

1. Field of the Invention

The present invention relates to encapsulated heating element fluid heaters for heating a fluid such as water and more particularly pertains to a new encapsulated heating element fluid heater for heating a fluid such as water.

2. Description of the Prior Art

The use of encapsulated heating element fluid heaters for heating a fluid such as water is known in the prior art. More specifically, encapsulated heating element fluid heaters for heating a fluid such as water heretofore devised and utilized are known to consist basically of familiar, expected and obvious structural configurations, notwithstanding the myriad of designs encompassed by the crowded prior art which have been developed for the fulfillment of countless objectives and requirements.

Known prior art encapsulated heating element fluid heaters for heating a fluid such as water include U.S. Pat. No. 4,687,138; U.S. Pat. No. 3,997,114; U.S. Pat. No. 5,662,269; U.S. Pat. No. 3,760,982; U.S. Pat. No. 3,645,420; U.S. Pat. No. 5,529,460; U.S. Pat. No. 3,134,889; EPO Patent No. EP 0 515 0173 A1 (Inventor: Pirl); PCT Patent No. WO 86/07628 (Inventor: Sten); U.S. Pat. No. 5,292,056; U.S. Pat. No. 4,345,549; U.S. Pat. No. 4,364,161; and PCT Pat. No. WO 97/31748 (Inventor: Swidwa).

Encapsulated heating element fluid heaters typically comprise a vessel with an open end and an end cap having a plurality of heating element rods extending through bores in the end cap. A sealing material such as an electrically insulating epoxy is used to seal the space around each of the heating element rods in the bores of the end cap. The heating element rods are inserted into the vessel through the open end of the vessel until the end cap covers the opening of the vessel. The end cap is then coupled to the vessel to form a water-tight closure of the opening of the vessel. Fluid, such as water, is then passed through the interior of the encapsulated heating element fluid heater to be heated by the heating element rods. Encapsulated heating element fluid heaters are generally quite large in size and are required to withstand large amounts of pressure from the fluid passing through them. Because of this pressure, the seal between the open end of the vessel and the end cap must be quite strong.

In prior art encapsulated heating element fluid heaters, the vessel is usually constructed with an outwardly radiating flange around the open end of the vessel while the end cap is also constructed with a corresponding outwardly radiating flange around the end of the end cap being inserted into the open end of the vessel. These flanges are then bolted together to form a water tight coupling between the vessel and the end cap. A gasket may also be provided between the flanges to help ensure a water tight seal between the vessel and end cap. Because this coupling must be strong enough to withstand the high fluid pressures exerted from fluid in the interior of the encapsulated heating element fluid heater, these flanges on the vessel and the end cap tend to be rather large and extremely heavy.

This large size and weight makes can lead to problems in the use in typical applications of the prior art encapsulated heating element fluid heaters. For example, in portable applications, such as steam and fluid cleaners, which must be able to be easily moved about a work site by a user, the large size and weight of these types of prior art encapsulated heating element fluid heater cause problems with uneven distribution of weight of the application which makes the application unevenly balanced and easy to tip over. The large size and weight of the prior art encapsulated heating element fluid heater also makes it more difficult to lift applications using prior art encapsulated heating element fluid heaters.

One solution to reducing the weight of encapsulated heating element fluid heater is to remove the flanges from the vessel and the end cap and weld the vessel and end cap together. Removal of the flanges can reduce the weight of an encapsulated heating element fluid heater by more than 60 percent thereby making portable applications of the encapsulated heating element fluid heater more practical. However, there are several problems with this solution. One major problem with this welding solution is than the weld between the vessel and the end cap must be very strong to withstand the interior fluid pressures during use. To form a weld that is strong enough to achieve this, the area of the weld between the vessel and the end cap must be heated to a hot temperature. This heating causes the temperature of the entire end cap to heat up which leads melting the epoxy seals around each of the heating element rods in the end cap. Melting of the seals causes leaks in the encapsulated heating element fluid heater and also increases problems with the heating element rods shorting out when energized. Because of the risk of melting these seals, manufacturers of encapsulated heating element fluid heaters strongly warn against welding the end cap to the vessel, especially without use of any flanges on the vessel and end cap.

While these devices fulfill their respective, particular objectives and requirements, the aforementioned patents do not disclose a new encapsulated heating element fluid heater. The inventive device includes a vessel and an end cap. The end cap has a plurality of bores therethrough extending between the first and second ends of the end cap. A plurality of elongate heating element rods extend through the bores of the end cap and each heating element rod has a heating portion outwardly extending from the first end of the end cap and an electric coupling portion outwardly extending from the second end of the end cap. The first end of the end cap is inserted into an open end of the vessel such that the heating portions of the heating elements extend into the vessel. The end cap is then welded to the end of the vessel.

In these respects, the encapsulated heating element fluid heater according to the present invention substantially departs from the conventional concepts and designs of the prior art, and in so doing provides an apparatus primarily developed for the purpose of heating a fluid such as water.

SUMMARY OF THE INVENTION

In view of the foregoing disadvantages inherent in the known types of encapsulated heating element fluid heaters for heating a fluid such as water now present in the prior art, the present invention provides a new encapsulated heating element fluid heater construction wherein the same can be utilized for heating a fluid such as water.

The general purpose of the present invention, which will be described subsequently in greater detail, is to provide a new encapsulated heating element fluid heater apparatus and method which has many of the advantages of the encapsulated heating element fluid heaters for heating a fluid such as water mentioned heretofore and many novel features that result in a new encapsulated heating element fluid heater which is not anticipated, rendered obvious, suggested, or even implied by any of the prior art encapsulated heating element fluid heaters for heating a fluid such as water, either alone or in any combination thereof.

To attain this, the present invention generally comprises a vessel and an end cap. The end cap has a plurality of bores therethrough extending between the first and second ends of the end cap. A plurality of elongate heating element rods extend through the bores of the end cap and each heating element rod has a heating portion outwardly extending from the first end of the end cap and an electric coupling portion outwardly extending from the second end of the end cap. The first end of the end cap is inserted into an open end of the vessel such that the heating portions of the heating elements extend into the vessel. The end cap is then welded to the end of the vessel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new encapsulated heating element fluid heater apparatus and method which has many of the advantages of the encapsulated heating element fluid heaters for heating a fluid such as water mentioned heretofore and many novel features that result in a new encapsulated heating element fluid heater which is not anticipated, rendered obvious, suggested, or even implied by any of the prior art encapsulated heating element fluid heaters for heating a fluid such as water, either alone or in any combination thereof.

It is another object of the present invention to provide a new encapsulated heating element fluid heater which may be easily and efficiently manufactured and marketed.

It is a further object of the present invention to provide a new encapsulated heating element fluid heater which is of a durable and reliable construction.

An even further object of the present invention is to provide a new encapsulated heating element fluid heater which is susceptible of a low cost of manufacture with regard to both materials and labor, and which accordingly is then susceptible of low prices of sale to the consuming public, thereby making such encapsulated heating element fluid heater economically available to the buying public.

Still yet another object of the present invention is to provide a new encapsulated heating element fluid heater which provides in the apparatuses and methods of the prior art some of the advantages thereof, while simultaneously overcoming some of the disadvantages normally associated therewith.

Still another object of the present invention is to provide a new encapsulated heating element fluid heater for heating a fluid such as water.

Yet another object of the present invention is to provide a new encapsulated heating element fluid heater which includes a vessel and an end cap. The end cap has a plurality of bores therethrough extending between the first and second ends of the end cap. A plurality of elongate heating element rods extend through the bores of the end cap and each heating element rod has a heating portion outwardly extending from the first end of the end cap and an electric coupling portion outwardly extending from the second end of the end cap. The first end of the end cap is inserted into an open end of the vessel such that the heating portions of the heating elements extend into the vessel. The end cap is then welded to the end of the vessel.

Still yet another object of the present invention is to provide a new encapsulated heating element fluid heater that eliminates the need for flanges to attach the end cap to the vessel of the encapsulated heating element fluid heater thereby reducing the weight and encumbrance of the encapsulated heating element fluid heater.

Even still another object of the present invention is to provide a new encapsulated heating element fluid heater that solves the problem of overheating the end cap beyond the melting temperature of the seals around the heating element rods of the end cap by using a chill bar to maintain the temperature of the end cap around the seals of the heating element rods below the melting temperature of the seals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
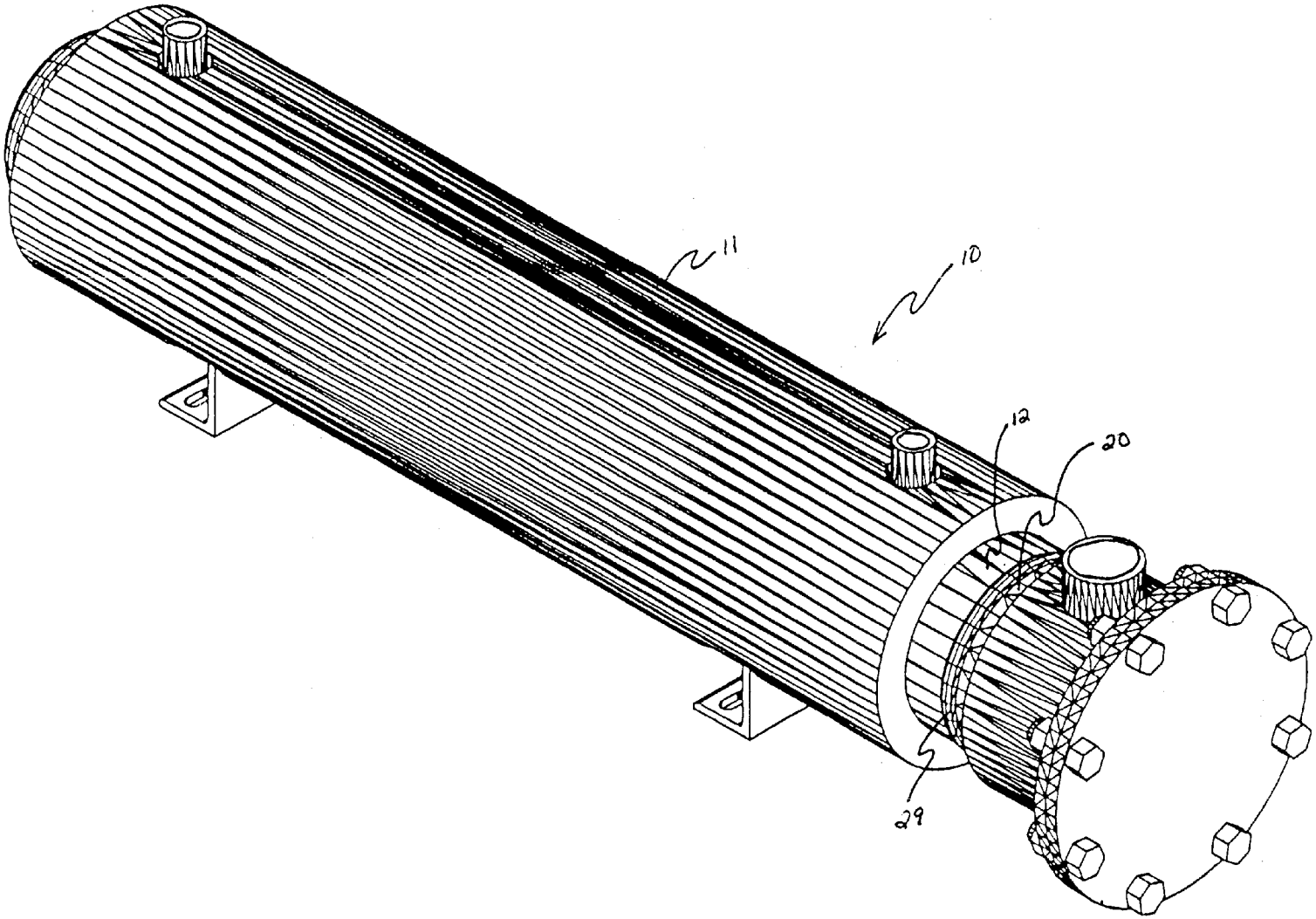
FIG. 1 is a schematic perspective view of a new encapsulated heating element fluid heater according to the present invention.

With reference now to the drawings, and in particular to FIGS. 1 through 8 thereof, a new encapsulated heating element fluid heater embodying the principles and concepts of the present invention and generally designated by the reference numeral 10 will be described.

As best illustrated in FIGS. 1 through 8, the encapsulated heating element fluid heater 10 generally comprises a vessel 11 and an end cap 20. The end cap 20 has a plurality of bores 23 therethrough extending between the first and second ends 21,22 of the end cap 20. A plurality of elongate heating element rods 25 extend through the bores 23 of the end cap 20 and each heating element rod 25 has a heating portion 26 outwardly extending from the first end 21 of the end cap 20 and an electric coupling portion 27 outwardly extending from the second end 22 of the end cap 20. The first end 21 of the end cap 20 is inserted into an open end 12 of the vessel 11 such that the heating portions 26 of the heating element rods 25 extend into the vessel 11. The end cap 20 is then welded to the end 12 of the vessel 11.

In general, the method for assembling an encapsulated heating element fluid heater fluid heater using a vessel 11 and an end cap 20 first requires that inserts the first end 21 of the end cap 20 into the opening of the end 12 of the vessel 11 such that the heating portions 26 of the heating elements extend into the vessel 11. The end cap 20 is then cooled to maintain a generally constant temperature around the seals in the bores 23 of the end cap 20. Then the end 12 of the vessel 11 is welded to the first end 21 of the end cap 20 to couple the end cap 20 to the end 12 of the vessel 11.

Figure 2:
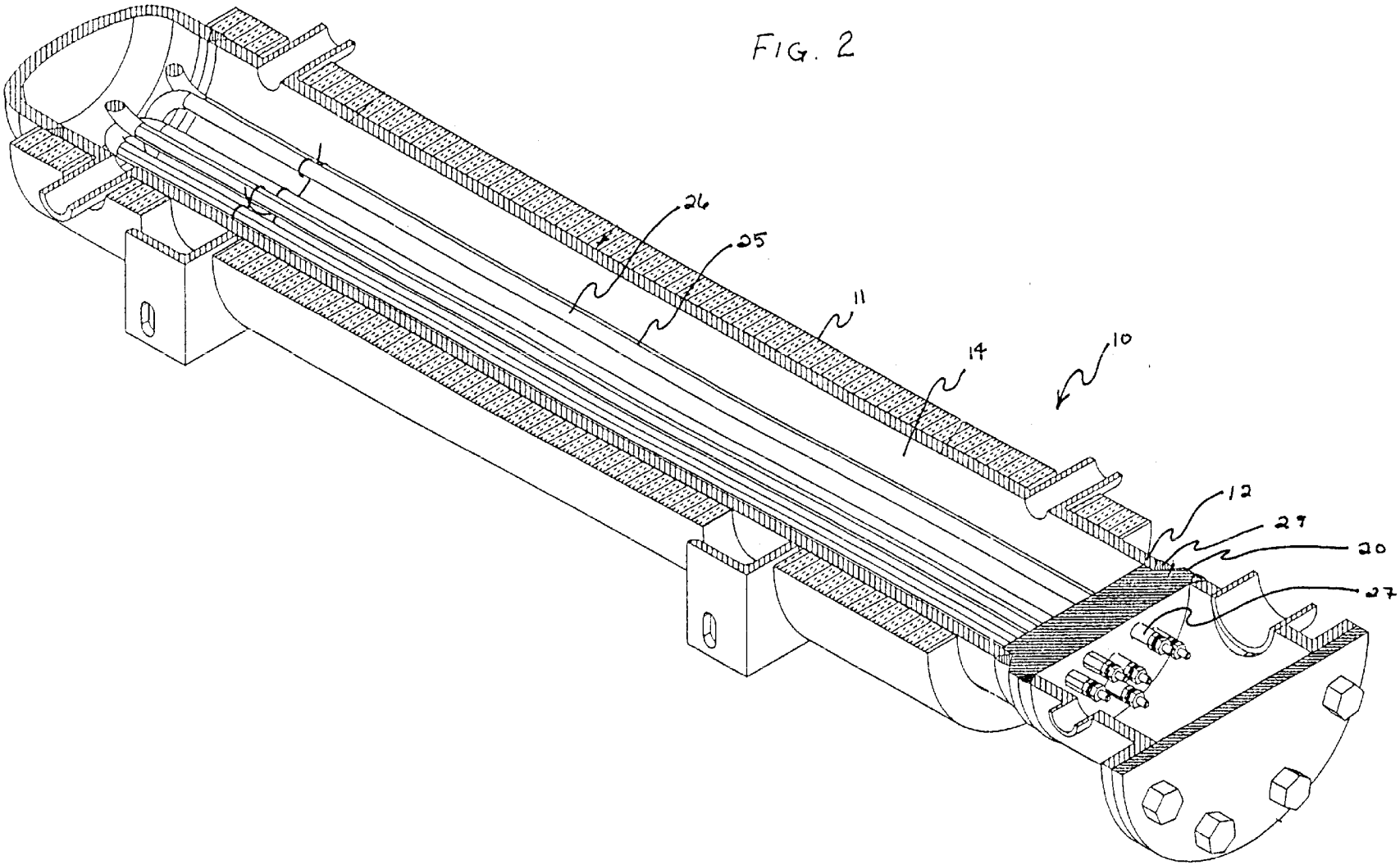
FIG. 2 is a schematic cross sectional view of the present invention.
Figure 4:
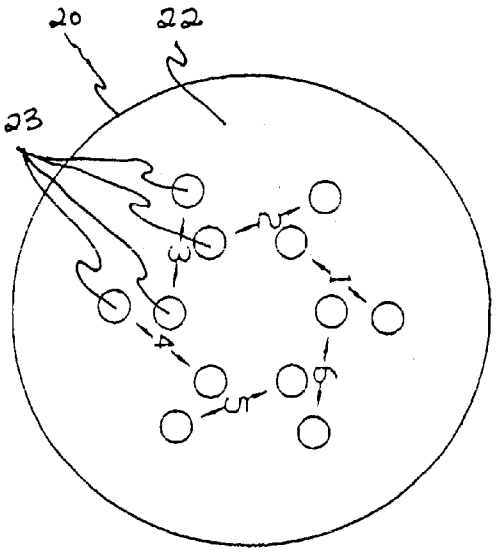
FIG. 4 is a schematic end view of the end cap of the present invention.
Figure 3:
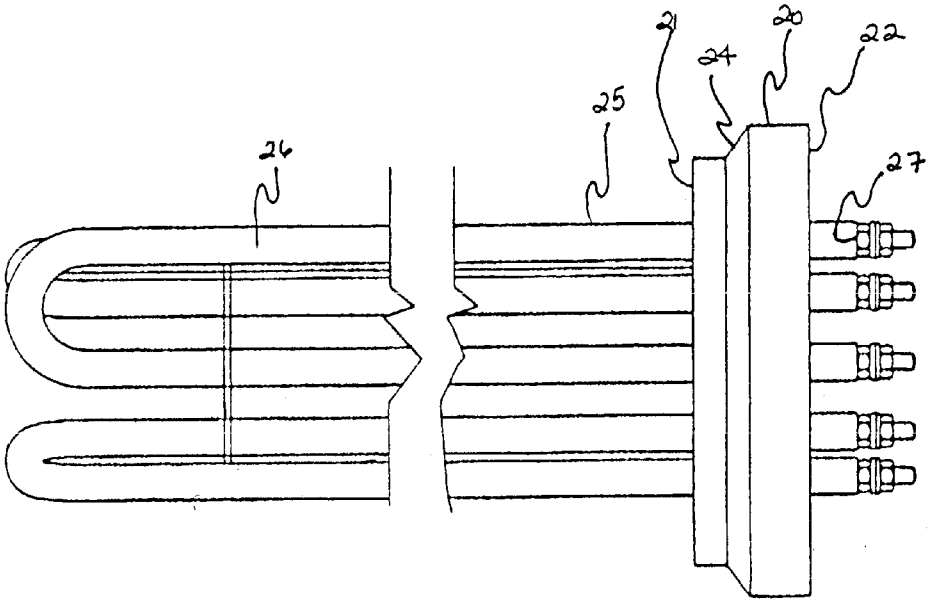
FIG. 3 is a schematic side view of the end cap and heating element rods of the present invention.

In closer detail, with reference to FIGS. 1 and 2, the vessel 11 is generally cylindrical and has an end 12 with a generally circular opening into the interior 14 of the vessel 11. The interior 14 of the vessel 11 is designed for holding fluid therein to be heated. Preferably, the end 12 of the vessel 11 includes an annular beveled weld edge therearound.

With reference to FIGS. 1 through 4, the end cap 20 is generally disc-shaped and has first and second ends 21,22. The end cap 20 also has a plurality of bores 23 therethrough extending between the first and second ends 21,22 of the end cap 20. The first end 21 of the end cap 20 also preferably has an annular beveled edge therearound.

A plurality of elongate heating element rods 25 are extended through the bores 23 of the end cap 20. The heating element rods 25 each have has a heating portion 26 outwardly extending from the first end 21 of the end cap 20 and an electric coupling portion 27 outwardly extending from the second end 22 of the end cap 20. The electric coupling portions 27 are adapted to electrical connection to a power source such that the heating portions 26 provide heat to heat fluid in the interior of the vessel when energized. Typically, each of the bores 23 of the end cap 20 has an seal therein for substantially sealing each of the bores of end cap 20 to prevent passage of fluid water through the bores 23 of the end cap 20. Commonly, the seals comprise an epoxy for providing electrical insulation between the heating element rods 25 and the end cap 20 to prevent shorting out of the heating element rods 25.

Each of the heating element rods 25 may have a U-shaped configuration (see FIGS. 2 and 3) with a base portion and two arm portions extending away from the base portion of the heating element rod. The arm portions of each of the heating element rods 25 extend through a pair of the bores 23 (see FIG. 4) in the end cap 20 with the base portion being oriented in the vessel 11 toward the first end 21 of the end cap. As may be appreciated from FIGS. 2 and 3, attachment of the end cap 20 on the vessel 11 prevents the heating element rods 25 from thereafter being inserted into or removed from the bores 23 of the end cap without removing the end cap from the vessel. As a result, the installation of the heating element rods 25 must be accomplished prior to a permanent attachment (such as, for example, by welding) of the end cap 20 on the vessel 11.

When assembling the encapsulated heating element fluid heater, the first end 21 of the end cap 20 is inserted into the opening of the end 12 of the vessel 11 such that the heating portions 26 of the heating element rods 25 extend into the interior 14 of the vessel 11. When fully inserted, the beveled weld edge of the end cap 20 is positioned adjacent the beveled weld edge of the end 12 of the vessel 11.

To weld the vessel and end cap together, the end cap 20 must be cooled to maintain a generally constant temperature around the seals in the bores 23 of the end cap 20 to prevent the seals for melting when the first end 21 of the end cap 20 is welded to the open end 12 of the vessel 11. To achieve this, a chill bar 30 is provided for cooling the end cap 20 during welding. The chill bar 30 generally comprises a base 31 and a cap member 40.

Figure 5:
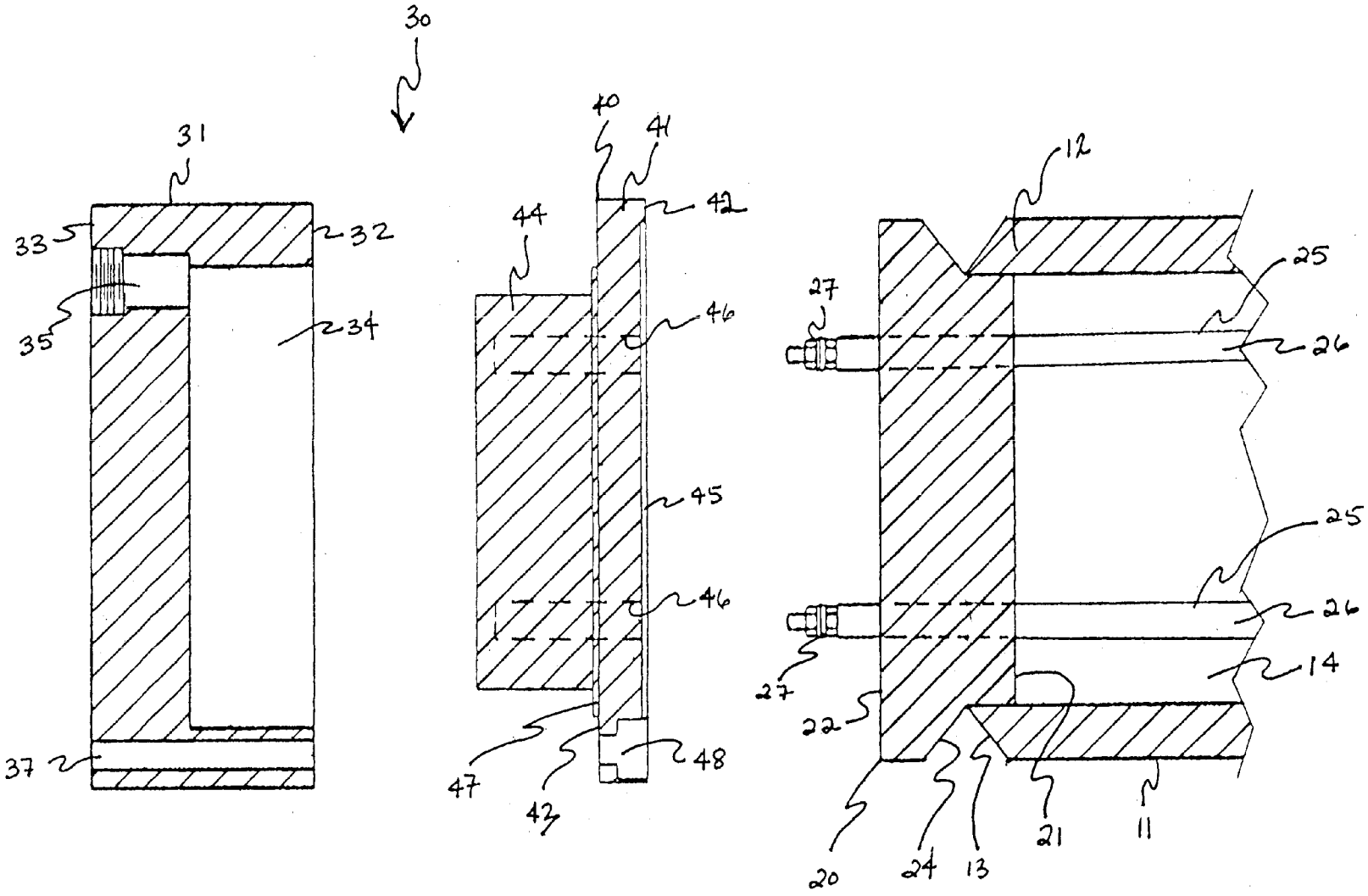
FIG. 5 is a schematic exploded sectional view of the present invention with a chill bar before welding.
Figure 6:
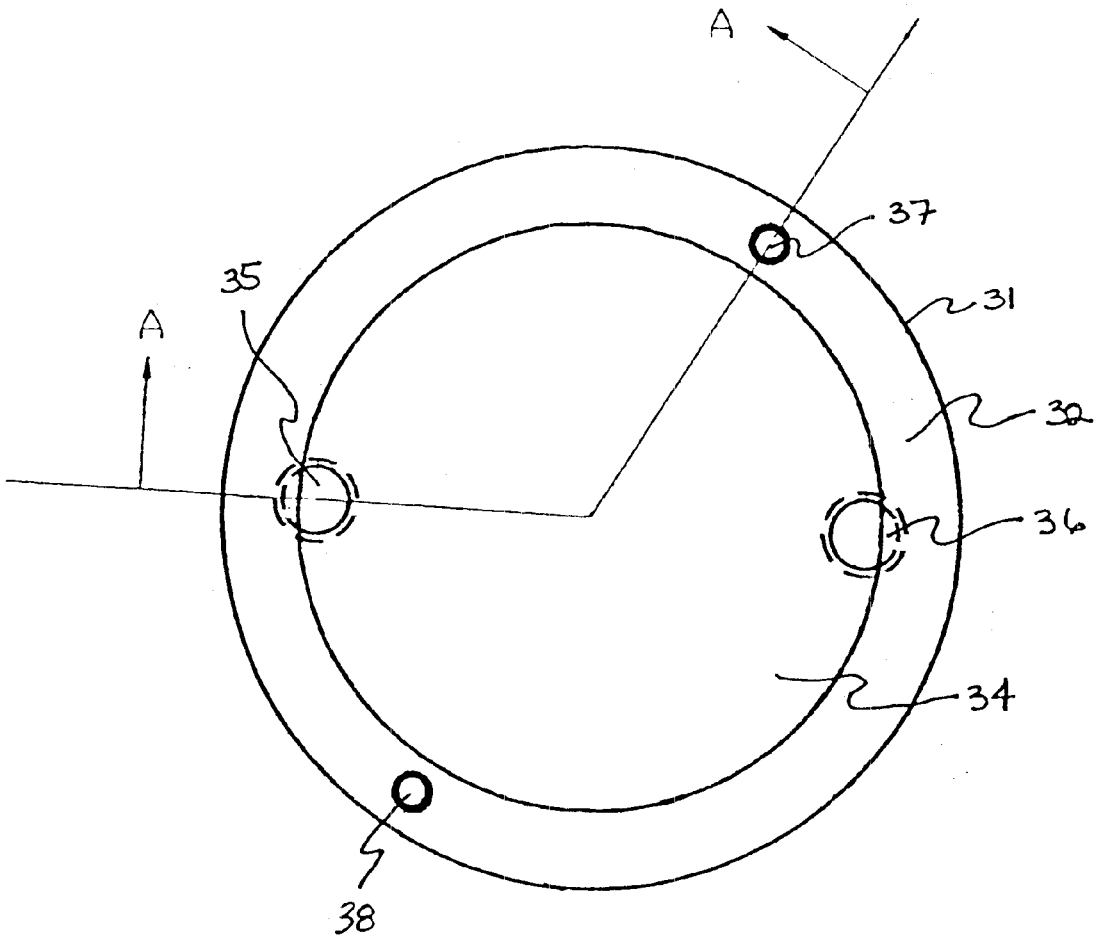
FIG. 6 is a schematic side view of the first face of the base of the chill bar of the present invention with the line A—A representing the location of the cross section of the base of the chill bar depicted in FIG. 5.

With reference to FIGS. 5 and 6, the base 31 is generally cylindrical and has first and second faces 32,33. The first face 32 of the base 31 has central cavity 34 therein which is preferably generally cylindrical. The base 31 preferably includes a pair of diametrically spaced apart elongate bolt holes 37,38 extending therethrough between the first and second faces 32,33 of the base 31. The base 31 also has a pair of inlet and outlet fluid passages 35,36 extending between the second face 33 of the base 31 and the cavity 34 of the base 31. Preferably, the fluid passages 35,36 are positioned adjacent the circumference of the cavity 34 of the base 31. The fluid passages 35,36 is designed for fluidly connecting the cavity 34 of the base 31 to a coolant fluid reservoir. Ideally, each of the fluid passages 35,36 of the base 31 has a threaded portion adjacent the second face 33 of the base 31 to permit threaded attachment of each of the fluid passages 35,36 to an end of a hose from the coolant fluid reservoir to fluidly connect the fluid passages 35,36 to the coolant fluid reservoir.

Figure 7:
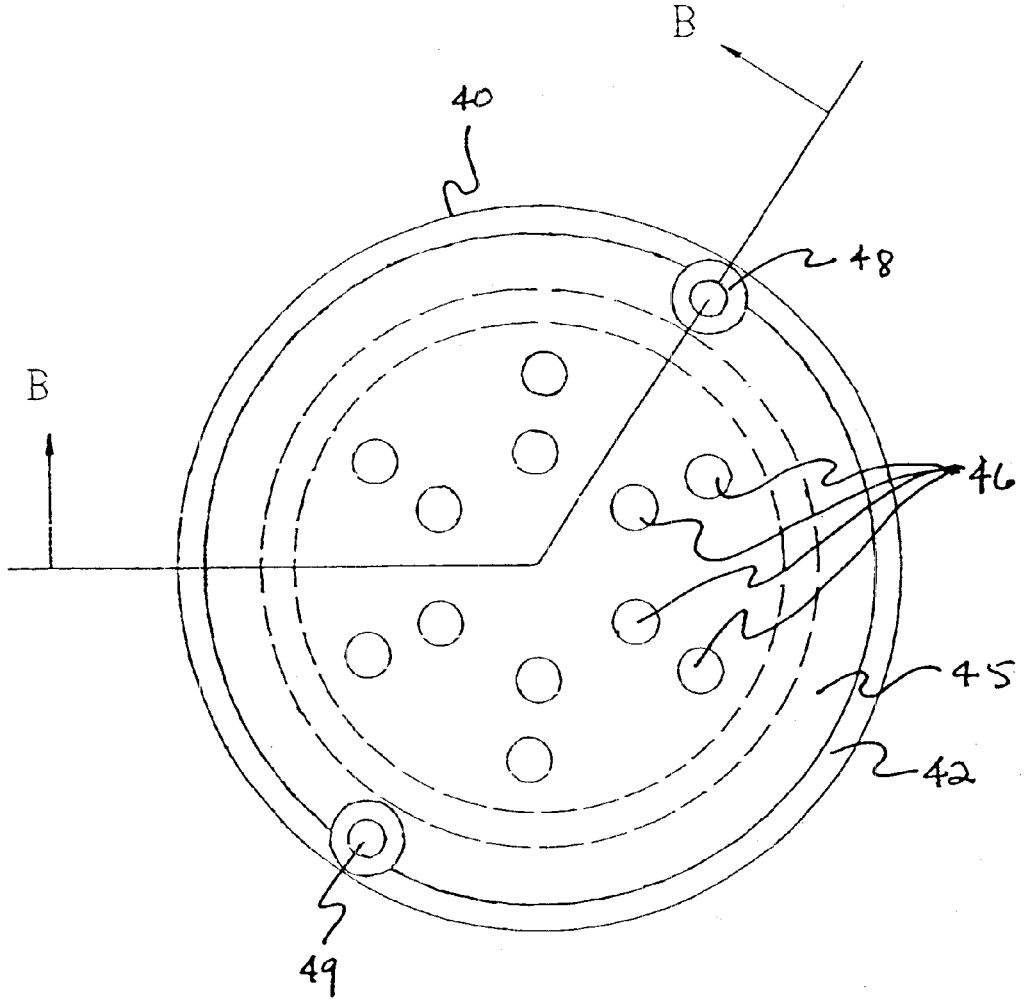
FIG. 7 is schematic side view of the first face of the cap member of the chill bar of the present invention with the line B—B representing the location of the cross section of the cap member of the chill bar depicted in FIG. 5.

With reference to FIGS. 5 and 7, the cap member 40 has a cover portion 41 and an central insertion portion 44. The cover portion 41 of the cap member 40 is preferably generally disk-shaped and has first and second faces 42,43. The insertion portion 44 of the cap member 40 is also preferably generally cylindrical with the diameter of the insertion portion 44 of the cap member 40 less than the diameter of the cavity 34 of the base 31. The insertion portion 44 of the cap member 40 outwardly extends from the second face 43 of the cover portion 41 of the cap member 40.

The first face 42 of the cover portion 41 of the cap member 40 preferably has a circular depression 45 therein with the diameter of the depression 45 slightly greater than the diameter of the second end 22 of the end cap 20. As illustrated in FIG. 7, the first face 42 of the cover portion 41 of the cap member 40 has a plurality of spaced apart receiving bores 46 therein extending through the cover portion 41 of the cap member 40 and into the insertion portion 44 of the cap member 40. The receiving bores 46 of the first face 42 of the cover portion 41 of the cap member 40 are positioned in the depression 45 of the first face 42 of the cover portion 41 of the cap member 40. The receiving bores 46 are designed for receiving the electric coupling portions 27 of the heating element rods 25 therein. Accordingly, the receiving bores 46 are arranged to correspond with the arrangement of the electric coupling portions 27 of the heating element rods 25 extending from the end cap 20. The second face 43 of the cover portion 41 of the cap member 40 preferably has an annular ridge 47 around the circumference of the insertion portion 44 of the cap member 40. The ridge 47 of the second face 43 of the cover portion 41 of the cap member 40 has an outer circumference which is preferably less than the circumference of the cavity. The cover portion 41 of the cap member 40 also has a pair of retainer holes 48,49 therethrough between the first and second faces 42,43 of the cover portion 41 of the cap member 40.

Figure 8:
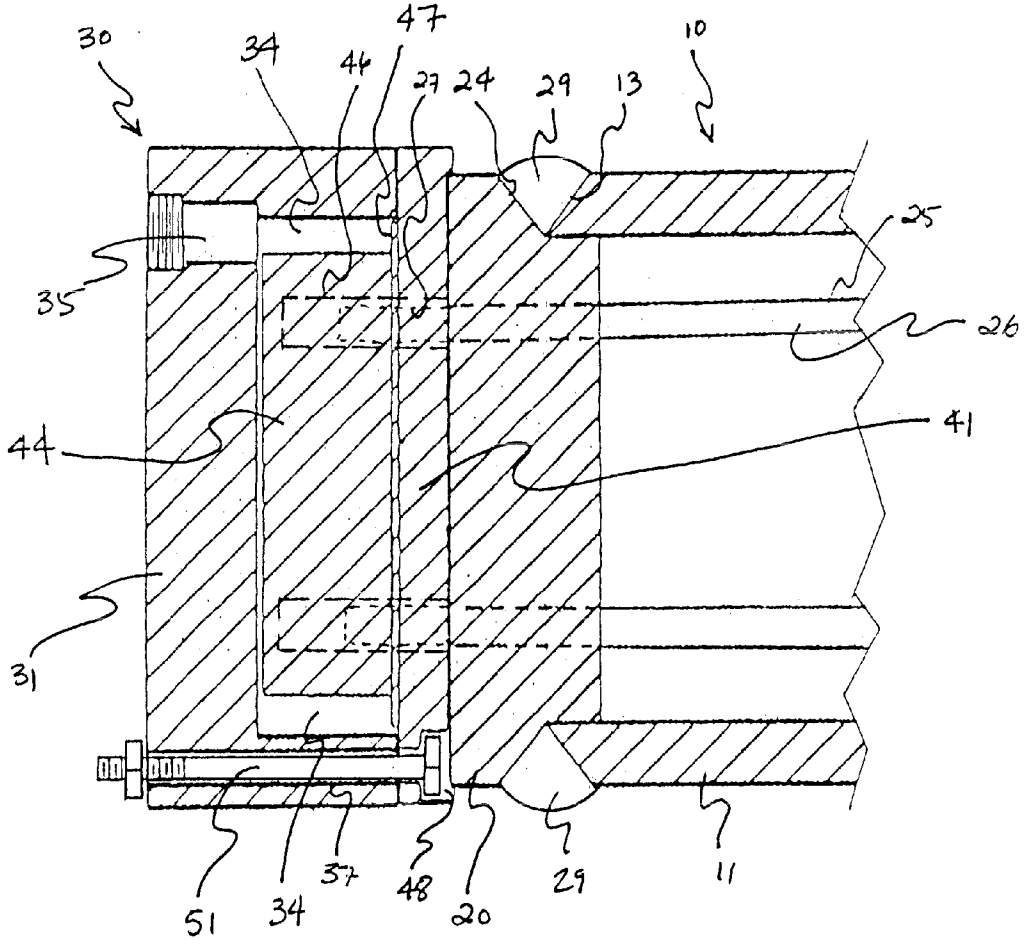
FIG. 8 is a schematic sectional view of the present invention with the chill bar attached and the location of the weld between the beveled weld edges of the end cap and vessel.

As illustrated in FIG. 8, the insertion portion 44 of the cap member 40 is inserted into the cavity 34 of first face 32 of the base 31 such that an annular cooling space 50 is defined between the circumference of the cavity 34 of the base 31 and the circumference of the insertion member of the cavity 34. The cooling space 50 is designed for circulating coolant fluid therein. The insertion portion is inserted into the cavity until the second face 43 of the cover portion 41 of the cap member 40 abuts the first face 32 of the base 31 such that the ridge 47 of the second face 43 of the cover portion 41 of the cap member 40 is inserted into the cavity 34 of the first face 32 of the base 31. Preferably, one of the retaining holes of the cover portion of the base is coaxially aligned with one of the bolt holes of the base and the other retaining hole of the cover portion of the base is coaxially aligned with the other bolt hole of the base. A retaining bolt 51 is then extended through each pair of associated retaining and bolt holes 48,49,37,38 to couple the cap member 40 to the base 31 preferably to provide a water tight seal therebetween.

Next, the electric coupling portions 27 of the heating element rods 25 are inserted into the receiving bores 46 of the cap member 40 of the chill bar 30 such that each electric coupling portion 27 is inserted into an associated receiving hole. The electric coupling portions are inserted into the receiving bores until the first face 42 of the cover portion 41 of the cap member 40 of the chill bar 30 abuts against the second end 22 of end cap 20 such that the second end 22 of the end cap 20 is inserted into the depression 45 of the first face 42 of the cover portion 41 of the cap member 40 of the chill bar 30.

Coolant fluid is then circulated through the cooling space 50 of the chill bar 30 from a coolant fluid reservoir such that the seals in the bores 23 of the end cap 20 are maintained at a temperature below a predetermined temperature. Ideally, the predetermined temperature is about 160 degrees Fahrenheit (above which risks causes melting of the seals around the heating element rods). This then permits welding 29 of the beveled weld edge of the end 12 of the vessel 11 to the beveled weld edge of the first end 21 of the end cap 20 to couple the end cap 20 to the end 12 of the vessel 11 and to provide a water tight seal the opening of the end 12 of the vessel 11. The chill bar 30 is then removed from the end cap 20 to permit use of the encapsulated heating element heater such as in installation to a fluid cleaning device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method for assembling an encapsulated heating element fluid heater fluid heater, comprising the acts of:

providing a vessel having an end, said end of said vessel having an opening therein;

providing an end cap having first and second ends, said end cap having a plurality of bores therethrough extending between said first and second ends of said end cap, said end cap having a plurality of elongate heating element rods extending through said bores of said end cap, said heating element rods having a heating portions outwardly extending from said first end of said end cap, said heating element rods having electric coupling portions outwardly extending from said second end of said end cap, each of said bores of said end cap having a seal therein for substantially sealing each of said bores of end cap to prevent passage of fluid through said bores of said end cap;

inserting said first end of said end cap into said opening of said end of said vessel such that said heating portions of said heating elements extend into said vessel;

cooling said end cap to maintain a generally constant temperature around said seals in said bores of said end cap; and welding said end of said vessel to said first end of said end cap to couple said end cap to said end of said vessel.

2. The method of claim 1, wherein the step of cooling said end cap further comprises the step of:

providing a chill bar comprising a base and a cap member, said base having first and second faces, said first face of said base having cavity therein, said base having a pair of fluid passages extending between said second face of said base and said cavity of said base, said fluid passages being positioned adjacent to said circumference of said cavity of said base, said fluid passages being adapted for fluidly connecting said cavity of said base to a coolant fluid reservoir, said cap member having a cover portion and an insertion portion, said cover portion of said cap member having first and second faces, said insertion portion being outwardly extended from said second face of said cover portion of said cap member, said insertion portion of said cap member being inserted into said cavity of said first face of said base such that a cooling space is defined between the outer perimeter of said cavity of said base and said insertion member of said cavity, and said second face of said cover portion of said cap member abutting said first face of said base.

3. The method of claim 2, further comprising the act of inserting said electric coupling portions of said heating element rods into said receiving bores of said cap member of said chill bar such that each electric coupling portion is inserted into an associated receiving hole.

4. The method of claim 3, further comprising the act of abutting said first face of said cover portion of said cap member of said chill bar against said second end of said end cap.

5. The method of claim 3, further comprising the act of circulating coolant fluid through said cooling space of said chill bar such that said seals in said bores of said end cap are maintained at a temperature below a predetermined temperature.

6. The method of claim 1, wherein said end of said vessel has a beveled weld edge, wherein said first end of said end cap has a beveled edge, wherein said beveled weld edge of said end cap is positioned adjacent said beveled weld edge of said end of said vessel when said first end of said end cap is inserted into said opening of said end of said vessel, and wherein the act of welding said end of said vessel to said first end of said end cap further comprises welding said beveled weld edge of said end of said vessel to said beveled weld edge of said first end of said end cap.

7. A method for assembling an encapsulated heating element fluid heater fluid heater, comprising the acts of:

providing a vessel being generally cylindrical and having an end, said end of said vessel having an opening therein, said end of said vessel having a beveled weld edge;

providing an end cap having first and second ends, said end cap having a plurality of bores therethrough extending between said first and second ends of said end cap, said first end of said end cap having a beveled edge, said end cap having a plurality of elongate heating element rods extending through said bores of said end cap, said heating element rods having a heating portions outwardly extending from said first end of said end cap, said heating element rods having electric coupling portions outwardly extending from said second end of said end cap, each of said bores of said end cap having a seal therein for substantially sealing each of said bores of end cap to prevent passage of fluid through said bores of said end cap, said seals comprising an epoxy;

inserting said first end of said end cap into said opening of said end of said vessel such that said heating portions of said heating elements extend into said vessel, said beveled weld edge of said end cap being positioned adjacent said beveled weld edge of said end of said vessel;

providing a chill bar comprising a base and a cap member, said base being generally cylindrical and having first and second faces, said first face of said base having cavity therein, said cavity being generally cylindrical and having a diameter and a circumference, said base having a pair of elongate bolt holes extending therethrough between said first and second faces of said base, said base having a pair of fluid passages extending between said second face of said base and said cavity of said base, said fluid passages being positioned adjacent said circumference of said cavity of said base, said fluid passages being for fluidly connecting said cavity of said base to a coolant fluid reservoir, said cap member having a cover portion and an insertion portion, said cover portion of said cap member being generally disk-shaped and having first and second faces, said insertion portion of said cap member being generally cylindrical and having a diameter and a circumference, said insertion portion of said cap member being outwardly extended from said second face of said cover portion of said cap member, said diameter of said insertion portion of said cap member being less than said diameter of said cavity of said base, said first face of said cover portion of said cap member having a circular depression therein, said first face of said cover portion of said cap member having a plurality of spaced apart receiving bores therein extending through said cover portion of said cap member and into said insertion portion of said cap member, said receiving bores of said first face of said cover portion of said cap member being positioned in said depression of said first face of said cover portion of said cap member, said second face of said cover portion of said cap member having an annular ridge around said circumference of said insertion portion of said cap member, said ridge of said second face of said cover portion of said cap member having an outer circumference, said cover portion of said cap member having a pair of retainer holes therethrough between said first and second faces of said cover portion of said cap member, said insertion portion of said cap member being inserted into said cavity of first face of said base such that an annular cooling space is defined between said circumference of said cavity of said base and said circumference of said insertion member of said cavity, said second face of said cover portion of said cap member abutting said first face of said base such that said ridge of said second face of said cover portion of said cap member is inserted into said cavity of said first face of said base, one of said retaining holes of said cover portion of said base being coaxially aligned with one of said bolt holes of said base, another of said retaining holes of said cover portion of said base being coaxially aligned with another of said bolt holes of said base, a retaining bolt being extended through each pair of associated retaining and bolt holes to couple said cap member to said base;

inserting said electric coupling portions of said heating element rods into said receiving bores of said cap member of said chill bar such that each electric coupling portion is inserted into an associated receiving hole;

abutting said first face of said cover portion of said cap member of said chill bar against said second end of end cap such that said second end of said end cap is inserted into said depression of said first face of said cover portion of said cap member of said chill bar;

circulating coolant fluid through said cooling space of said chill bar such that said seals in said bores of said end cap are maintained at a temperature below a predetermined temperature, wherein said predetermined temperature is about 160 degrees Fahrenheit; and welding said beveled weld edge of said end of said vessel to said beveled weld edge of said first end of said end cap to couple said end cap to said end of said vessel.

* * * * *